US009102510B1

(12) United States Patent
Cortner et al.

(10) Patent No.: US 9,102,510 B1
(45) Date of Patent: Aug. 11, 2015

(54) OVERTURNED TANKER FUEL RECOVERY SYSTEM

(71) Applicants: Randy Cortner, Brentwood, TN (US); Blake Cortner, Nolensville, TN (US)

(72) Inventors: Randy Cortner, Brentwood, TN (US); Blake Cortner, Nolensville, TN (US)

( * ) Notice: Subject to any disclaimer, the term of this patent is extended or adjusted under 35 U.S.C. 154(b) by 0 days.

(21) Appl. No.: 14/478,724

(22) Filed: Sep. 5, 2014

(51) Int. Cl.
*B67D 7/02* (2010.01)
*B67D 7/04* (2010.01)
*B67D 7/38* (2010.01)

(52) U.S. Cl.
CPC ... *B67D 7/38* (2013.01); *B67D 7/04* (2013.01)

(58) Field of Classification Search
USPC ..... 141/98, 369, 370, 383–386; 137/15.08, 137/315.41, 327
See application file for complete search history.

(56) References Cited

U.S. PATENT DOCUMENTS

| | | | | | |
|---|---|---|---|---|---|
| 3,631,880 | A | | 1/1972 | Hansel | |
| 3,970,107 | A | | 7/1976 | Bower | |
| 3,989,155 | A | | 11/1976 | Conklin | |
| 4,071,012 | A | * | 1/1978 | Cooke | 137/321 |
| 4,150,809 | A | * | 4/1979 | Muller | 251/149.4 |
| 4,230,002 | A | * | 10/1980 | Skidmore | 81/124.7 |
| 4,373,547 | A | | 2/1983 | Gels et al. | |
| 4,470,437 | A | | 9/1984 | Rabinovich | |
| 4,672,932 | A | * | 6/1987 | Schmidt | 123/196 A |
| 4,800,933 | A | * | 1/1989 | Moore et al. | 141/98 |
| 5,209,456 | A | * | 5/1993 | Chronister | 251/144 |
| D363,501 | S | * | 10/1995 | Daniel | D15/150 |
| 5,704,383 | A | * | 1/1998 | Kammeraad et al. | 137/15.14 |
| 5,725,009 | A | * | 3/1998 | Mallow et al. | 137/15.09 |
| 5,852,961 | A | * | 12/1998 | Kotowski | 81/180.1 |
| 5,907,110 | A | * | 5/1999 | Garcia et al. | 73/864.74 |
| 6,293,163 | B1 | * | 9/2001 | Johnston et al. | 73/864.74 |
| 6,338,357 | B1 | * | 1/2002 | Zevgolis | 137/15.16 |
| 6,959,741 | B1 | | 11/2005 | Fishel | |
| 8,561,629 | B2 | * | 10/2013 | Mougin | 137/15.16 |
| 8,899,254 | B1 | * | 12/2014 | Weiler | 137/15.08 |

FOREIGN PATENT DOCUMENTS

| | | |
|---|---|---|
| CA | 1214150 | 11/1986 |
| EP | 2402211 | 1/2012 |
| GB | 2355257 | 4/2001 |
| GB | 2411891 | 9/2005 |

* cited by examiner

*Primary Examiner* — Nicolas A Arnett
(74) *Attorney, Agent, or Firm* — Bradley Arant Boult Cummings LLP; Jacob W Neu

(57) ABSTRACT

Apparatuses and methods for removing liquid, such as oil, gas, or fuel, from an overturned tanker truck are disclosed herein. One or more ports are provided along the side of a tanker truck compartment, which may be accessed in the event of a rollover of the tanker truck. The port is sealed during normal use of the truck but may be opened from the outside in order to remove fuel. Additionally, an opening tool is disclosed in the event the port is below the internal liquid surface level, in order to prevent spills.

7 Claims, 7 Drawing Sheets

OVERTURNED TANKER FUEL RECOVERY SYSTEM

FIELD OF THE INVENTION

The invention relates generally to fuel tankers and hazardous material recovery.

BACKGROUND ART

Tanker truck accidents involving overturned gas tankers are unfortunately a common cause for hazardous material recovery operations. In the United States alone, it is estimated that as many as 1300 fuel truck tankers overturn every year. When a tanker truck is involved in a rollover accident and the product on board remains intact (e.g., there is no fire, explosion, or leak), it is necessary that the fuel be removed from the damaged tanker onsite, as any unnecessary relocation or repositioning of the tanker can cause dangerous and environmentally harmful fuel leaks.

However, the process currently used for offloading fuel from a tanker truck is also highly dangerous. When a hazardous material (HAZMAT) team arrives on site to remove the fuel, the tanker is typically in a position that does not allow for removal via the usual ports located on the tanker for loading or unloading of fuel. Rather, the tanker is turned on its side or on its top, and furthermore, it may have skidded off the road into a nearby ditch or other unstable location. In these situations, the conventional process calls for one HAZMAT crew member to climb onto the overturned tanker and drill a hole through the uppermost side of the tank containing the fuel. Drilling into a metal tanker can cause sparks, which may lead to an explosion of the fuel or fuel vapors and is extremely dangerous. To reduce the chance for an explosion, the HAZMAT team continually sprays vapor-suppressing foam on the location of the drilling. The foam, however, may contaminate the local environment. Moreover, the vapor-suppressing foam is also extremely slippery, which creates a safety hazard for recovery personnel on or around the tanker.

Once the drilling is completed, a hose is inserted into the tank so that fuel may be pumped out of the tank. However, this fuel is contaminated by the drilling shavings and by any foam that entered the tank, and so it is unusable for its intended purpose as fuel after recovery. Additionally, the drilled hole is roughly made, such that any hose inserted into the hole does not fit snugly. This means that gas vapors will continue to escape during the offloading process, so the vapor-suppressing but environmentally harmful foam must continue to be sprayed on or near the location of the drilled hole. This process must be repeated for each individual compartment of the tanker.

What is needed, then, is a tanker designed for easy and efficient offloading of fuel in the event of a rollover accident that does not require drilling holes into the tanker. Furthermore, a process and apparatus is needed for offloading the loaded tanker in a manner that is not only safe and environmentally friendly but preserves the product from contamination due to drilling and foaming.

SUMMARY OF THE INVENTION

In some aspects, the invention relates to an apparatus for the removal of a liquid from a rolled-over tanker truck, the apparatus having a liquid tank having a compartment for carrying liquid and a coupler on a lateral side of the compartment, the coupler having an aperture and a fitting for receiving a hose; a removable seal plug inserted into the aperture; a hose adapted to be inserted into the compartment through the aperture and having an external coupling for engaging the fitting, such that when engaged, a first end of the hose is inside the tank compartment; and an external compartment in fluid connection with a second end of the hose, the external compartment capable of receiving the liquid in the liquid tank.

In other aspects, the invention relates an apparatus for removing liquid from a rolled over tanker truck, the apparatus having a liquid tank having a compartment for carrying liquid, and a coupler on a lateral side of the compartment, the coupler having an aperture and a fitting for receiving a hose; a removable seal plug inserted into the aperture; and a tool for removing the seal plug, the tool having a hollow body having an open end and a second end, a perforated plate bisecting the interior of the body, and a rod extending from the perforated plate towards the open end, the rod head adapted to remove the seal plug, where the open end is adapted to engage the coupler prior to the complete removal of the seal plug.

In other aspects, the invention relates to a method for removing liquid from a rolled over tanker truck, the method having the steps of identifying a preexisting emergency port on the side of the tanker truck substantially opposite from the ground; unsealing the port; inserting a first end of a hose into the aperture, such that the body of the hose is inside the compartment; securing a second end of the hose to the port; connecting the second end of the hose to a removal tank; and pumping the liquid from the compartment to the removal tank.

Other aspects and advantages of the invention will be apparent from the following description and the appended claims.

BRIEF DESCRIPTION OF DRAWINGS

It should be noted that identical features in different drawings are shown with the same reference numeral.

DETAILED DESCRIPTION

Figure 1:
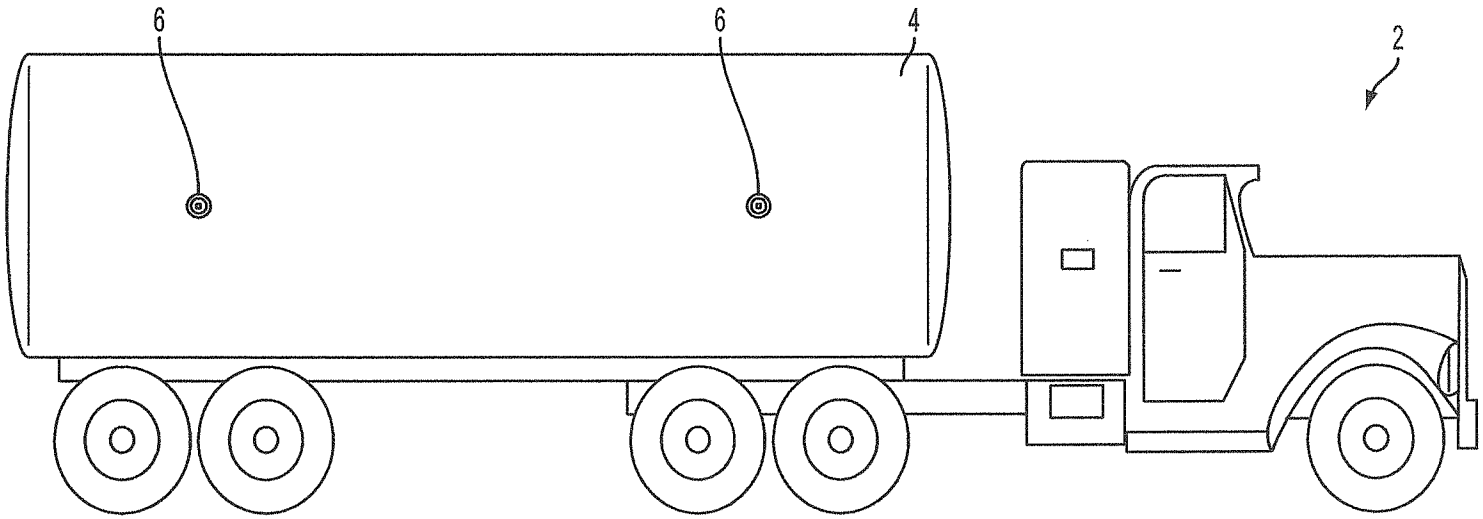
FIG. 1 depicts a tanker truck having a fuel offloading apparatus in accordance with one embodiment of the disclosure.

FIG. 1 depicts a tanker truck (or "tanker") that is used to carry liquefied loads and adapted to be used according to the apparatuses and methods disclosed herein. Tankers may carry any type of liquid load, which may or may not be pressurized, be hazardous, be temperature-regulated, or have other liquid- or transport-specific characteristics. The apparatuses and methods disclosed herein may be used in conjunction with a tanker carrying any liquefied load without restriction. However, the apparatus and methods disclosed are particularly directed to the removal of hazardous or environmentally sensitive loads, such as oil, natural gas, industrial chemicals or fluids (such as the liquids used in hydraulic fracturing), and gasoline and other fuels. These fluids pose a particular danger to clean up crews and are preferably retrieved and disposed of in an environmentally sensitive manner.

As shown in FIG. 1, tanks 4 for tanker or fuel trucks 2 often have multiple compartments separated by internal dividing walls. The multiple compartments allow a tanker to be filled with multiple different liquids without cross-contamination. The tank 4 in FIG. 1 has two compartments, as indicated externally by the ports 6 on the side of the tank 4, which are discussed further below. Tanks 4 have any number of separate compartments, or just one compartment. Each compartment has a separate fill port that connects to that compartment for loading a liquid. Fill valves are typically located near the bottom of the tank compartments for easy hookup with the hoses delivering the liquid to be transported. A tank 4 also typically has a vent on top of the tank 4 for offgassing vapors during loading and allowing air trapped in the tank 4 to escape as the volume is filled with the transported liquid. This prevents the tank 4 from overpressurizing. During unloading, the process is reversed; a hose is attached to the fill valve for unloading the liquid, and the vent may be opened to prevent a vacuum from developing in the tank 4, which can disrupt the outflow of the liquid and cause structural damage.

Figure 2:
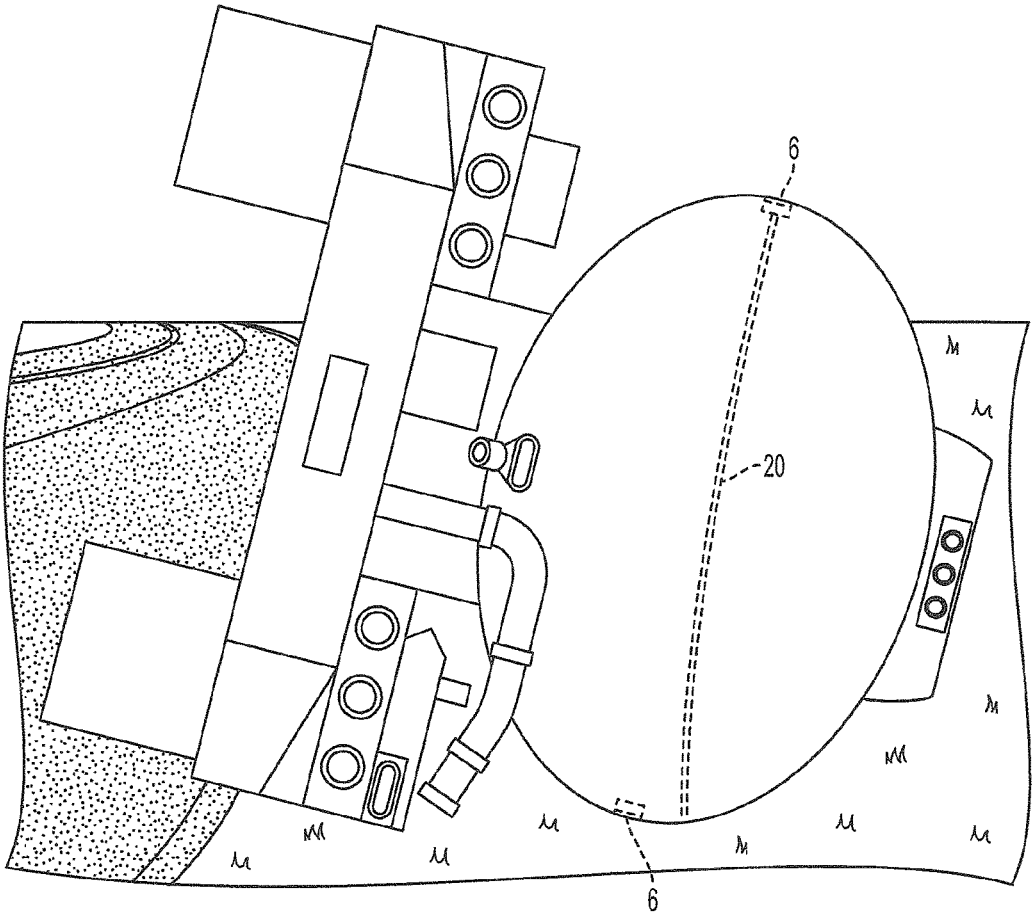
FIG. 2 depicts an overturned fuel truck with the offloading apparatus with hose inserted, in accordance with one embodiment of the disclosure.

Fill valves on the bottom of the tank 4 and vents on the top are appropriate for the efficient and normal use of the tank 4 during loading and unloading. However, after a rollover accident, a tank 4 is often laying on one side or the other, which prevents the normal operation of the fill valve and vent. For example, the fill valve is often located near the bottom of the compartment, often on one side or the other of tank 4. If the truck 2 rolls over onto that side, the fill valve is inaccessible. Even if the fill valve is potentially available it may be damaged or otherwise unable to be operated normally. Moreover, if the compartment is full of liquid, the vent (which is now on the "side" rather than the "top" of the rolled over vehicle) cannot be opened without allowing liquid to drain from the compartment. As a result, the standard practice of HAZMAT crews has been to drill a hole from the "top" of the rolled over or overturned tank 4. FIG. 2 depicts a rolled over tank 4. As shown, the fill valves are inaccessible, and the vent cannot be opened without risking spills.

To address this situation, the truck 2 shown in FIG. 1 has a port 6 for emergency use on each side of each compartment. The port 6 may be variously referred to as a port, hole, aperture, or bung. Each port 6 is preferably located on the tank 4 approximately where it would be most directly on "top" in the event of a rollover. Many tanks 4 are substantially cylindrical or oval in shape, in which case the port 6 would be located approximately halfway up the lateral side of the compartment (e.g., the ports would be at about the 9 o'clock and 3 o'clock positions if the tank 4 were viewed from the rear). In other configurations, such as a square or rectangular tank shape, or one in which the tank's widest diameter is not halfway between the top and bottom of the tank 4, the port 6 may be located in a different location. Furthermore, because a truck 2 may roll into a ditch or an incline, it is not certain in any case that the port 6 will always be directly "on top" when needed to be accessed. Thus, while the above design preference is the most likely to result in a port 6 that is on "top," it is not always possible given the essentially unknown situation in which the port 6 will be needed. So long as the port 6 is accessible at or near the "top" side of the rolled over tank 4, the methods disclosed below may be used. If desired, multiple ports 6 may be provided on each side of each compartment, such that any one port 6 is substantially close to being on "top" in the event of a roll over. FIG. 2 depicts the ports on one lateral side of the tank 4 in the "top" position. However, this is not necessary, and may be redundant if particular embodiments described below are used on the tank 4.

Figure 3:
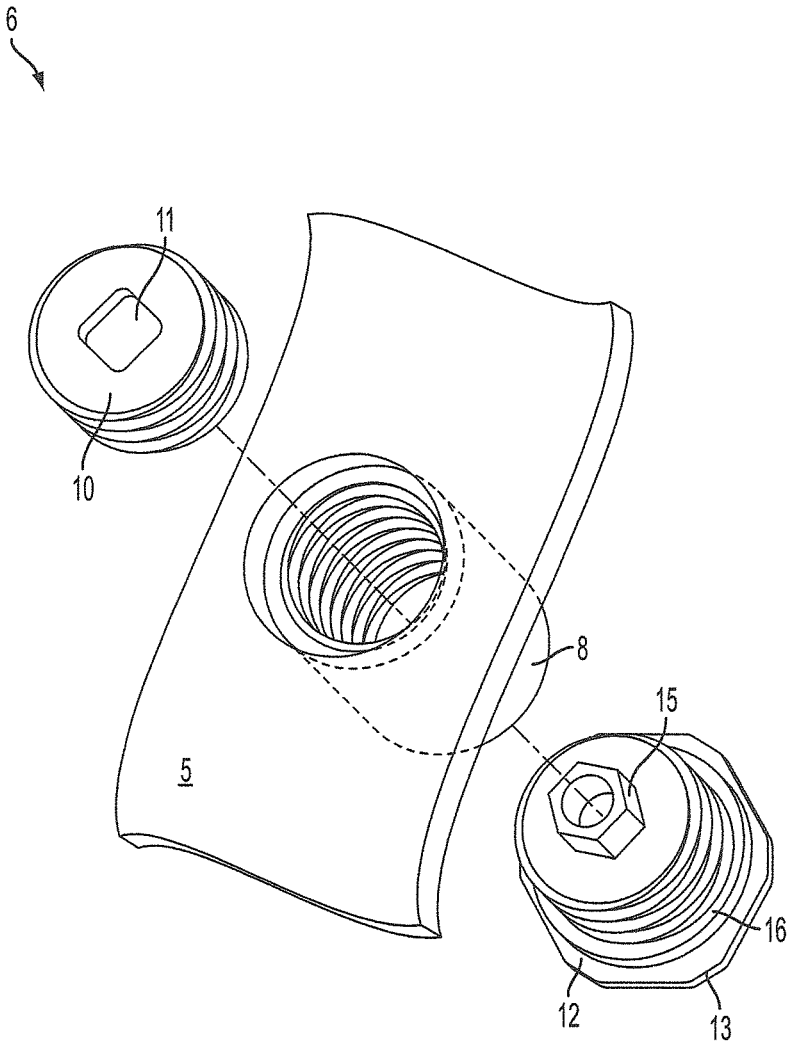
FIG. 3 depicts a close-up view of the port for the offloading apparatus, in accordance with one embodiment of the disclosure.

In normal use, the port 6 is plugged to prevent leaks. One embodiment of a port 6, cover plug 10, and seal plug 12 are depicted in FIG. 3. The port 6 has a small coupler 8 attached to the tank shell 5 which allows a hose 20 to be inserted into the tank 4. A cover plug 10 (also called a bung or bung plug) covers the outward end of the port 6 during normal use of the tank 4. The cover plug 10 and coupler 8 shown in FIG. 3 are threaded such that the cover plug 10 screws into the coupler 8. A cover plug 10 is not strictly necessary in all embodiments, since a seal plug 12 described below may also be provided. However a cover plug 10 may be more aesthetically pleasing, and if a unique head design for screwing or unscrewing the cover plug 10 is used, it may provide additional security to prevent accidental or malicious openings of the port 6.

A seal plug 12 seals off the internal side of the coupler 8 to prevent leaks. The seal plug 12 may be applied in a number of ways. For example, as shown in FIG. 3, the seal plug 12 is threaded to screw into the coupler 8 from the inside of the tank 4. An internal head 13 covers the end of the coupler 8 and a rubber sealing ring or gasket 16 is applied around the circumference of the seal plug 12 in order to seal off the coupler 8. Alternatively, a sealant may be applied to the exterior of the seal plug 12 which hardens and locks the seal plug 12 into place. While the threaded seal plug 12 is depicted in FIG. 3, other manners of sealing are also possible. Additionally, the plug 10 may be friction-fitted into the coupler 8, such as being a conical plug 10 that slides into place and locks. In this situation, the seal plug 12 may have a friction gasket rather than a separate rubber ring 16.

The seal plug 12 also has an external head 15 located on the end of the seal plug 12 that is screwed into the coupler 8. The external head of the seal plug 12 is adapted such that the seal plug 12 can be removed when needed. For example, the seal plug 12 in FIG. 3 has a hex-shaped external head 15 that allows the seal plug 12 to be unscrewed and removed from the coupler 8. The external head 15 may also be threaded with an internal threading, which provides the additional advantage of being opened according to the method described further below with reference to FIGS. 5-_ in the event the port 6 is not directly on top and falls below the surface line of the liquid in the compartment. One example of an external head 15 of this type is a nut welded to the end of the seal plug 12. Because the seal plug 12 screws into the coupler 8 from the inside of the tank 4, the direction of rotating the seal plug 12 to remove it is reversed when attempting to open the port 6 from the outside: screwing to the right will loosen and open the seal plug 12, while screwing to the left tightens it. Other heads are also possible; for example, if the seal plug 12 is a friction fit plug, a head having a protrusion capable of being grasped and pulled or pushed may be used.

In some embodiments, the port 6 may be further modified to have a puncturable or removable disc or cover secured across the port opening. In such embodiments, this is preferably located on the inside of the tanker shell 5 and covering the opening, so that the cover plug 10 remains easily accessible. The disc may be welded or otherwise permanently attached to the tanker shell 5. With the use of a disc welded along the shell 5, no separate seal plug 12 as shown in FIG. 3 would be necessary. If the disc is permanently attached, it should be thin to allow for easy puncturing or cutting without the need to drill it. In this case, the cover plug 10 may be may be designed to provide additional support to the disc to prevent blowouts or other damage due to the interior tank pressure on the thin disc. Permanent attachment, particularly welding, may result in a more permanent seal, but it does not have the advantages of using a threaded seal plug 12 as described further below in the event that the port 6 falls below the surface level of the liquid in the tank 4.

Figure 4:
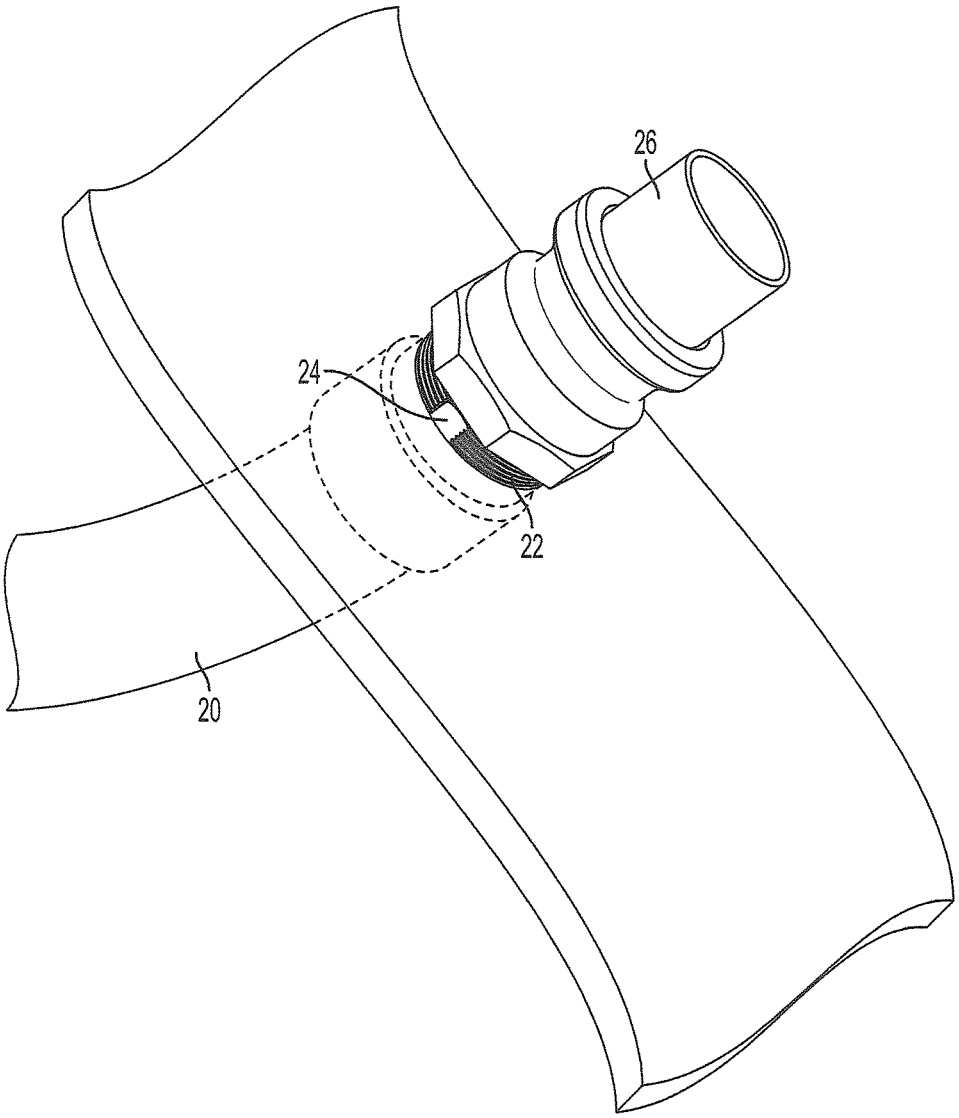
FIG. 4 depicts the port with the hose inserted and connected, in accordance with one embodiment of the disclosure.

In the event of a roll over, the port 6 on "top" may be accessed to remove the liquid inside. Although this procedure is described with particular reference to the embodiments shown in FIGS. 3 and 4, it may be easily adapted depending on the type of seal plug 12 used. First, the cover plug 10 is removed. Next, the seal plug 12 is unscrewed until it falls into the tank 4. If a disc or cover is provided, it is punctured or otherwise removed to allow access to the transported liquid. Once the cover plug 10 and seal plug 12 are removed, a hose 20 is provided to insert through the port 6 and into the tank 4. This is depicted in FIG. 4. The hose 20 may be provided with the truck 2, or it may be kept at the truck depot or with the HAZMAT team. Preferably, the hose 20 is flexible such that, when inserted into the compartment, it may be gravitationally directed down toward the "bottom" of the tank 2. However, this is not necessary, and a pipe or stiff hose 20 having the appropriate diameter for insertion through the port 6 may also be used if a flexible hose 20 is not available. The hose 20 or pipe should be long enough to come near the other side of the compartment once inserted, such that the intake end of the hose 20 or pipe is near the bottom of the fluid depth in the tank 4.

The second end 26 of the hose 20 has a fitting 22 for engaging the coupler 6. If the port 6 is threaded as in FIGS. 3 and 4, the fitting 22 should also be externally threaded to screw into the coupler 6. Although the fit should be snug, it should not be sealed or airtight. This allows air to be sucked into the tank 12 around the threads as the liquid is removed from the tank. This prevents a vacuum from developing inside the tank 4. As shown in FIG. 4, a small groove 24 is provided in the side of the threaded area to allow air to enter the tank during removal. Preferably, the threaded fitting 22 is a cam lock fitting, which is often used for fluid transport and connections.

If the port 6 is friction fitted, the fitting on the hose should engage the port 6 to fit snugly into the port 6 to prevent its coming loose. However, in order to prevent a vacuum, a small vent hole or opening similar to the groove 26 shown in FIG. 4 should be provided in the fitting to allow air to fill the tank as it is drained.

Once the hose is engaged into the port 6, the second end 26 is connected to an external storage or removal tank for collecting the liquid in the compartment. This connection is through hoses and other typical fittings for loading and unloading liquids. The external tank may be equipped with a pump to draw the liquid from the compartment.

Figure 5:
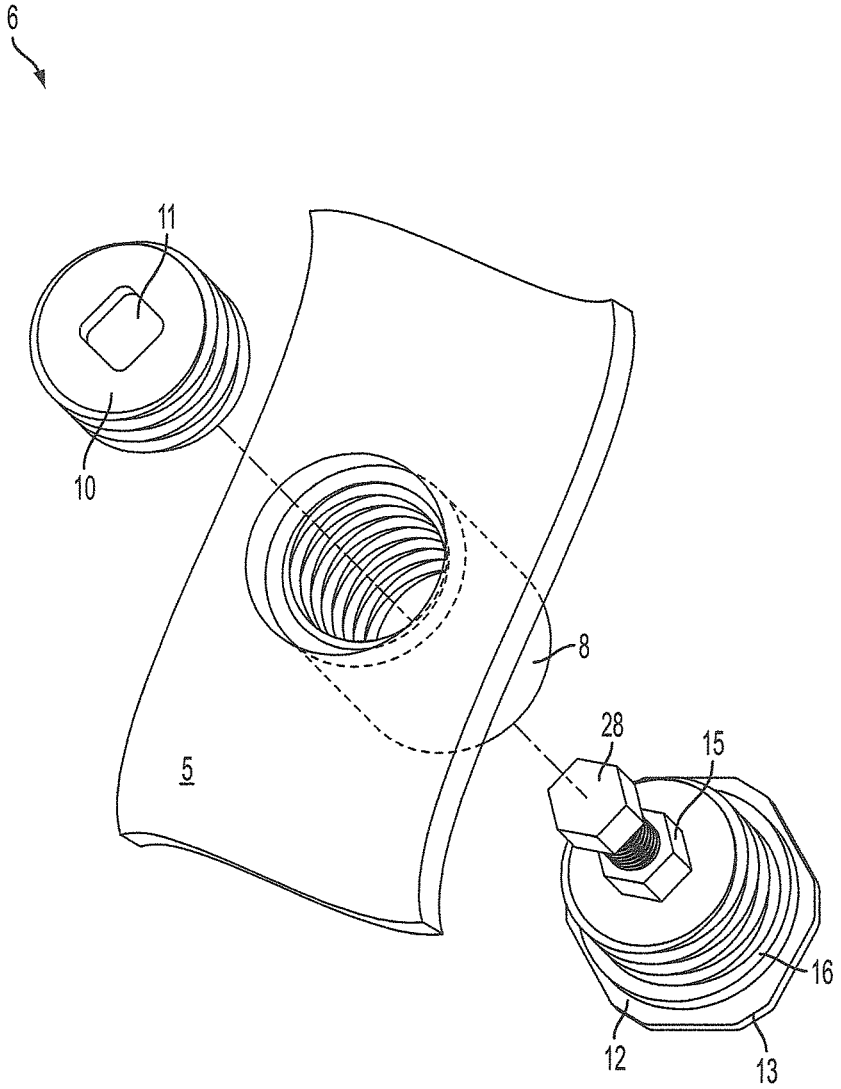
FIG. 5 depicts a close-up view of the port for the offloading apparatus, in accordance with another embodiment of the disclosure.

FIG. 5 depicts another embodiment of a port 6 for removing liquid from an overturned tanker. This embodiment is particularly advantageous when the truck 2 is overturned at an angle that is not at or near 90 degrees. In such a scenario, it is possible that the port 6 is located below the surface level of the liquid inside the compartment. If the tank were to be opened using the embodiment shown in FIGS. 3 and 4, then the liquid would pour out through the port as soon as it were open. This would result in loss of the transported liquid and create a safety hazard if the contents of the tank 2 are flammable, biologically sensitive, or environmentally hazardous.

To address this problem, the external head 15 of the seal plug 12 has an internal threading to receive a bolt 28, as depicted in FIG. 5. In some embodiments, and as shown here, the bolt 28 is screwed into the external hex head 15 of the seal plug 12, which is otherwise similar to the seal plug 12 shown in FIG. 3. The bolt 28 may be screwed into the external head 15 at the time of installation of the port 6 and seal plug 12, such that the bolt 28 is always present and is available at the time of a truck accident. In such embodiments, the bolt 28 is preferably kept in place by applying a thread-locking adhesive that prevents loosening due to shock or vibration, but which may be loosened by manual disassembly (an exemplary adhesive of this sort is currently sold under the brand name LOCTITE® THREADLOCKER). In other embodiments, the seal plug 12 with the appropriately threaded external head 15 may be installed on the truck 2 without a bolt 28. In these embodiments, the bolt 28 is brought with the HAZMAT team or other crew coming to remove the liquid from the tank 4, and the bolt 28 is screwed into the external head 15 at the time for removal of the contents of the tank 4.

Whether the bolt 28 is provided with the seal plug 12 as shown in FIG. 5, or is brought with the crew, the bolt 28 preferably is not screwed all the way into the external head 15 such that it fully engages the threaded head. Rather, the bolt 28 is backed out a couple turns from being fully engaged. In this position, it can be engaged by a socket 36 in the manner described further below.

Figure 6:
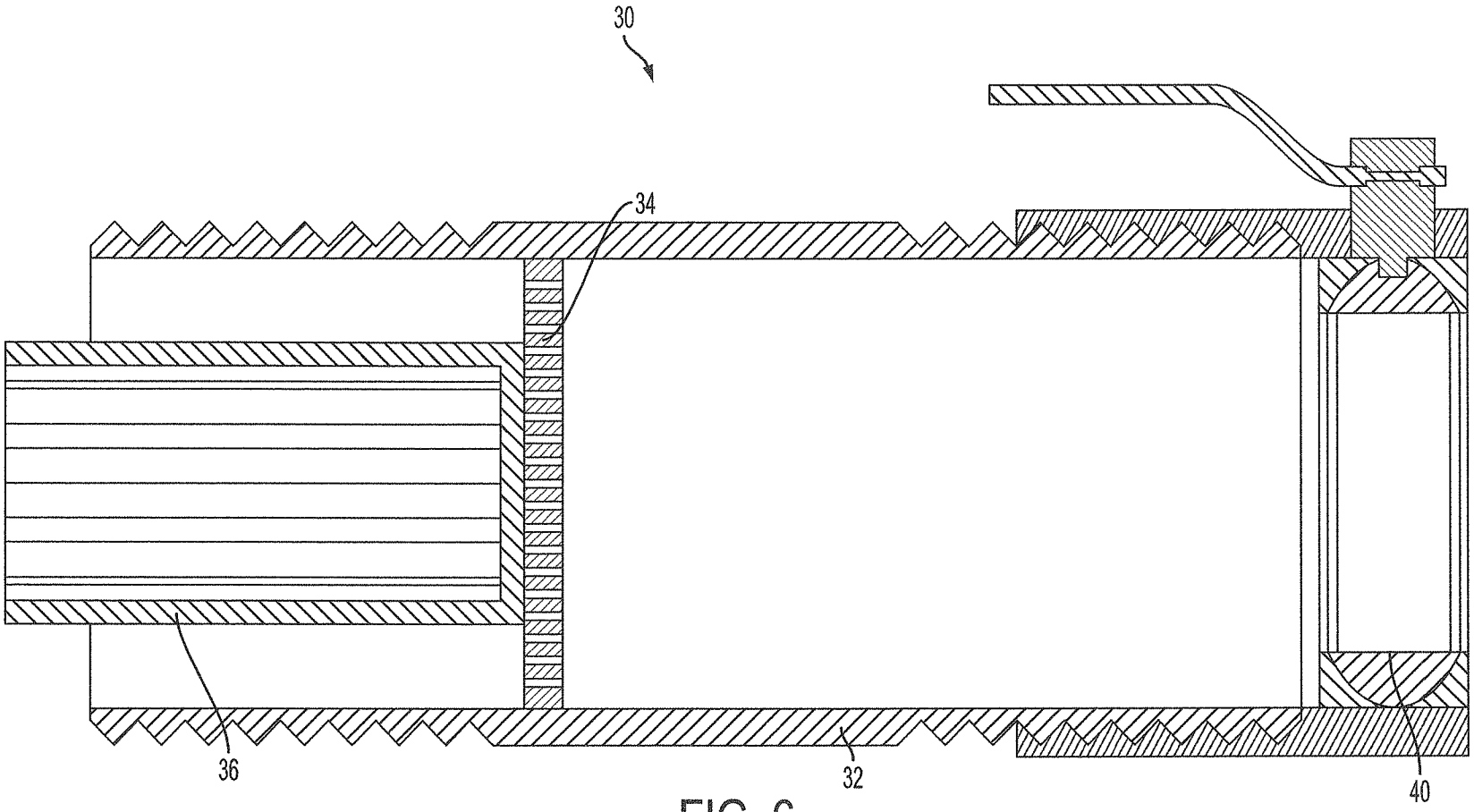
FIG. 6 depicts a tool for use when the port is below the internal surface level of the tank, in accordance with one embodiment of the disclosure.
Figure 7:
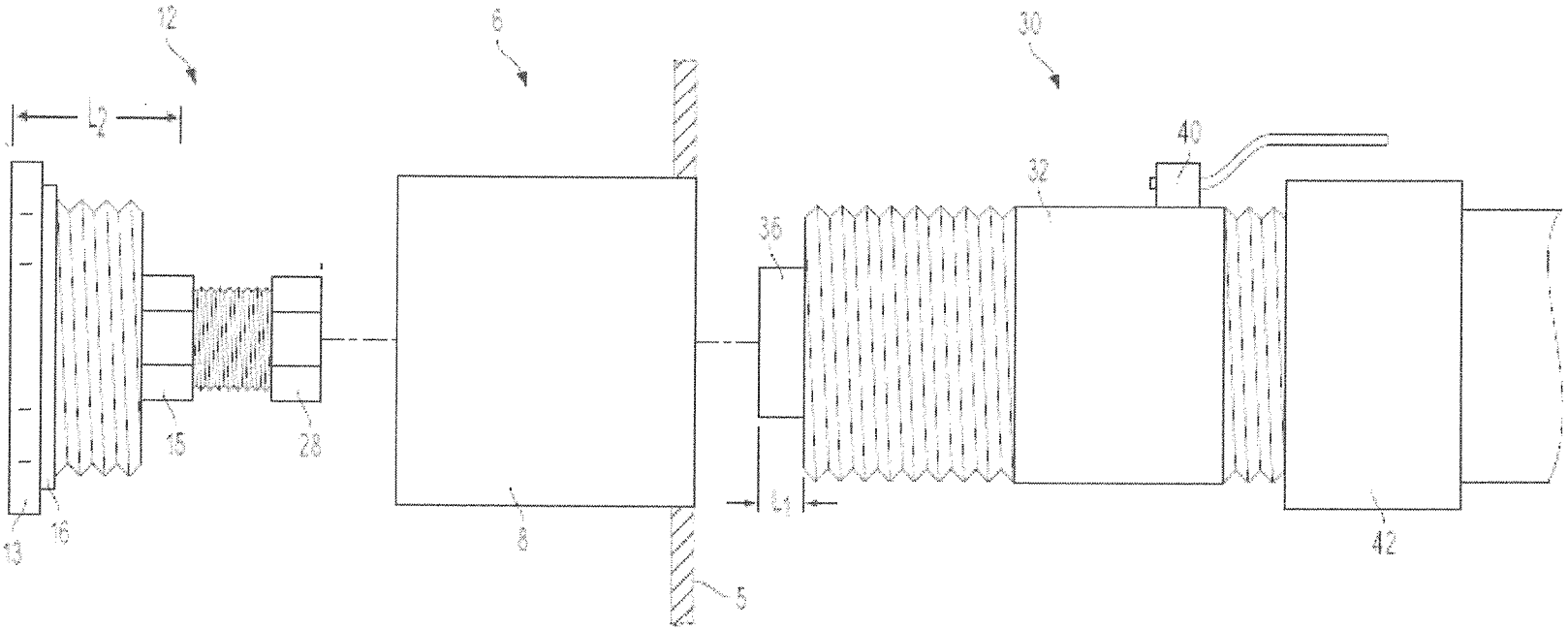
FIG. 7 depicts the use of the tool in a port, in accordance with one embodiment of the disclosure.

In order to remove the seal plug 12 and open the port 6, an opening tool 30 is provided, an example embodiment of which is shown as shown in FIG. 6. FIG. 7 depicts the opening tool 30 together with the seal plug 12 and coupler 8. The opening tool 30 is a short pipe 32 having external threading on one end to screw into the coupler 8 once the cover plug 10 is removed. The interior of the pipe 32 is bisected by a perforated plate 34. A socket 36 extends down from the middle of the plate 34 and towards the threaded end. The socket 36 is sized to engage and grasp the bolt 28. The socket 36 may extend all the way form the plate 34 as depicted in FIG. 6, or it may be in the form of a head attached to a solid extension or rod. The socket 36 is connected should be sized such that the end of the socket 36 does not extend farther past the threaded end of the pipe 28 (the distance shown as $L_1$ on FIG. 7) than the distance from the external end of the coupler 8 to the top internal head 15 of the seal plug 12 (the distance shown as $L_2$ on FIG. 7). Attached to the second end of the opening tool 30 is a ball valve 40, or such other valve as may be used to seal or open the second end of the opening tool 30.

In order to open the tank 4 when there is a risk that the port 6 is below the inner surface level of the liquid contents of the tank 4, the cover plug 10 is first removed from the coupler 6 to expose the seal plug 12. If the bolt 28 has not been previously screwed into the external head 15, the bolt 28 is screwed in now. As stated above, preferably the bolt 28 is not screwed all the way into the external head 15, but rather is left loose by about a turn or two. Next, the opening tool 30 is screwed into the coupler 8. Because $L_1$ is less than $L_2$, the socket 36 does not engage the bolt 28 until the opening tool 30 has been screwed a short distance into the coupler 8. In this way, the pipe 32 is screwed into the coupler 8 a short distance before the seal of the seal plug 12 is broken. Note that if $L_1$ were greater than $L_2$, the socket 36 would engage the bolt 28 before the pipe 32 engages the coupler 8, which would potentially result in liquid escaping once the seal is broken on the seal plug 12. For the socket 36 to engage the bolt 28 as the pipe 32 is screwed into the coupler 8, the socket 36 has to engage the bolt 28 in the proper alignment. For this reason, it is preferable for the bolt 28 is not screwed all the way into the external head 15. By not fully engaging the bolt 28 into the external head 15, the bolt 28 can be rotated a short amount by the socket 36 until the socket 36 fully engages the bolt 28. If the bolt 28 is already fully engaged into the external head 15, it is possible that the bolt 28 and socket 36 will not align correctly. However, it is not necessary that the bolt 28 be only partially engaged into the external head 15 prior to engaging the socket 36.

Once the socket 36 engages the bolt 28, the bolt 28 is screwed into the external head 15 at the same rate the pipe 32 is screwed into the coupler 8, until such time as the bolt 28 fully engages the external head 15 and does not screw any further in. However, the pipe 32 is not fully engaged into the coupler 8. Now, as the opening tool 30 is screwed into the external end of the port 6, the socket 36 turns the entire seal plug 12 because the bolt 28 is locked into the seal plug 12. Accordingly, as the pipe 32 screws into the external end of the coupler 8, the seal plug 12 is unscrewed from the internal end of the coupler 8. Once the seal plug 12 is fully unscrewed, it falls into the interior of the tank 4, as described above with reference to FIGS. 3 and 4.

Once open, liquid may flow into the internal volume of the port 6, but the opening tool 30 covers the external end because it is screwed into the port 6. The second end of the opening tool 30 is sealed by the ball valve 40. The perforated plate 32 allows the liquid to flow through the opening tool 30 up to the ball valve seal. Once the opening tool 30 is engaged and the seal plug 12 is removed, a hose 42 may be attached to the second end of the ball valve 40 and connected to an external storage tank. The ball valve 40 is then opened and the liquid is allowed to flow into the storage tank. A pump may be used to draw the liquid into the storage tank as well.

Once sufficient liquid has been removed such that the liquid level in the overturned truck 2 is no longer higher than the port 6, it will stop flowing. If a pump is being used, it will become apparent that it is operating at a low efficiency as it pulls air rather than liquid into the external storage tank. At this point the opening tool 30 is unscrewed from the port 6, and the hose 20 described with respect to FIG. 4 is inserted into the tank 4 and tightened and screwed into the port 6, in the manner described above. The remainder of the tank 4 may then be drained of the liquid using the procedures described above.

In addition to the embodiments depicted in FIGS. 5-7, other embodiments for engaging the seal plug and securely removing the liquid from the tank are possible. For example, where the seal plug is threaded as described above, the opening tool may be fitted with a screw head that screws directly into the head of the seal plug, rather than combining the use of a bolt and socket. Moreover, if the plug is friction-fitted, the opening tool can simply have a rod extension with a flat head, rather than a socket, for pushing the seal plug out of the coupler. In this case, the opening tool is preferably friction-fitted into the coupler or has a rubber seal ring to prevent leaks once inserted into the coupler. Other similar mechanisms may be used by those of skill in the art to engage the opening tool and remove the seal plug without departing from the scope of this disclosure.

The apparatuses and methods disclosed herein provide many advantages. The liquid stored in the compartments of the tank 4 may be removed without the need for drilling the compartment. This prevents leaks and spills from the liquid, which may be environmentally harmful and dangerous to the HAZMAT crew, and also prevents the need for drilling the tank, which can cause sparks and an explosion. Additionally, the need for vapor-suppressing foam is reduced or perhaps even completely eliminated. Moreover, the contents of the tank are not contaminated by the foam and drill shavings. Particularly with oil, natural gas, and gasoline, contamination results in the liquid becoming unusable, and it must be disposed. By this apparatus and method, the contents of the tank may be retrieved and sent on for further use rather than disposal.

While the invention has been described with respect to a limited number of embodiments, those skilled in the art, having benefit of this disclosure, will appreciate that other embodiments can be devised which do not depart from the scope of the invention as disclosed here. Accordingly, the scope of the invention should be limited only by the attached claims.

What is claimed is:

1. An apparatus for the removal of a liquid from a rolled-over tanker truck having a tank compartment for carrying liquid and having an aperture, the aperture comprising a coupler and a fitting for receiving a hose, the apparatus comprising:

a. a removable seal plug inserted into the aperture; and b. an opening tool for removing the seal plug, the opening tool comprising i. a hollow body having an open end and a second end, ii. a perforated plate bisecting the interior of the body, and iii. a rod extending from the perforated plate towards the open end, and having a rod head adapted to remove the seal plug, where the open end is adapted to engage the coupler prior to the complete removal of the seal plug.

2. The apparatus of claim 1, where the coupler and seal plug are threaded and the seal plug is screwed into the coupler.

3. The apparatus of claim 2, where the seal plug comprises a head having an internal threading.

4. The apparatus of claim 3, where the rod head is threaded to engage the seal plug head.

5. The apparatus of claim 3, further comprising a bolt engaged in the seal plug head, and where the rod head is a socket sized to engage the bolt.

6. The apparatus of claim 1, further comprising a ball valve attached to the second end of the opening tool.

7. The apparatus of claim 1, wherein the second end of the opening tool is in fluid connection with an external storage tank.

* * * * *